US008979144B2

(12) United States Patent
Paugh et al.

(10) Patent No.: US 8,979,144 B2
(45) Date of Patent: Mar. 17, 2015

(54) SELF-ALIGNING CATCH AND LATCH

(76) Inventors: Boake Paugh, Rancho Cucamonga, CA (US); Joshua R. Buesseler, Seattle, WA (US)

( * ) Notice: Subject to any disclaimer, the term of this patent is extended or adjusted under 35 U.S.C. 154(b) by 0 days.

(21) Appl. No.: 13/458,693

(22) Filed: Apr. 27, 2012

(65) Prior Publication Data

US 2013/0284743 A1 Oct. 31, 2013

(51) Int. Cl.

| | |
|---|---|
| ***E05C 3/06*** | (2006.01) |
| ***A45C 13/10*** | (2006.01) |
| ***E05B 65/52*** | (2006.01) |
| ***E05C 19/14*** | (2006.01) |

(52) U.S. Cl.

CPC ..... *E05B 65/52* (2013.01); *A45C 13/1084* (2013.01); *E05C 19/14* (2013.01)

USPC ..... 292/200

(58) Field of Classification Search

CPC ..... E05B 81/06; E05B 65/006; E05C 19/14

USPC ..... 292/1, 200, DIG. 49, 240, 241, 247, 292/304, 202, DIG. 48, DIG. 63; 24/69 R, 24/69 ST, 69 CF, 68 K, 71 R, 71 ST, 170, 24/191, 69 SK, 70 SK, 68 SK, 71 T, 68 E

See application file for complete search history.

(56) References Cited

U.S. PATENT DOCUMENTS

| | | | | |
|---|---|---|---|---|
| 960,961 | A * | 6/1910 | Kusterer | 292/247 |
| 1,400,953 | A * | 12/1921 | Hennicke | 292/247 |
| 2,820,995 | A * | 1/1958 | Schlueter | 403/182 |
| 3,237,978 | A * | 3/1966 | Swanson | 292/113 |
| 3,618,995 | A * | 11/1971 | McLean | 292/66 |
| 3,731,341 | A * | 5/1973 | Woodruff | 16/82 |
| 4,286,639 | A | 9/1981 | Murphy | |
| 4,692,034 | A | 9/1987 | Fukui et al. | |
| 5,149,203 | A | 9/1992 | Sacks | |
| 5,351,868 | A | 10/1994 | Beletsky et al. | |
| 6,542,757 | B2 | 4/2003 | Bae | |
| 6,722,544 | B1 * | 4/2004 | Stephens et al. | 224/659 |
| 6,966,519 | B2 | 11/2005 | Salentine et al. | |
| 7,530,457 | B2 | 5/2009 | Tsang | |
| 7,665,684 | B2 | 2/2010 | Salentine et al. | |
| 8,220,676 | B1 | 7/2012 | Hicks | |
| 8,333,310 | B2 | 12/2012 | Tages | |
| 8,600,461 | B2 | 12/2013 | Kroupa | |
| 8,631,980 | B2 | 1/2014 | Youssefi-Shams et al. | |
| 2002/0148078 | A1 | 10/2002 | Salentine et al. | |
| 2002/0153733 | A1 * | 10/2002 | Fuchs | 292/200 |
| 2003/0040285 | A1 | 2/2003 | Whitley | |

(Continued)

*Primary Examiner* — Kristina Fulton
*Assistant Examiner* — Nathan Cumar
(74) *Attorney, Agent, or Firm* — Christie, Parker & Hale, LLP

(57) ABSTRACT

A latch and catch assembly is provided to secure two or more components together in a locked or closed position. In one embodiment, the assembly includes a catch and a tensile member connected to a latch, wherein the assembly is moveable between an open position and a closed position. The catch includes a lip configured to engage a recess formed in the latch when the assembly is in the closed configuration. In a further embodiment, the latch includes a pull-tab extending from the latch, wherein the pull-tab is configured to enable the user to move the assembly between the open position and the closed position. In another embodiment, the catch has a wider proximal portion which tapers to a narrower distal portion, such that the catch has a "V"-shaped planform.

17 Claims, 6 Drawing Sheets

(56) References Cited

U.S. PATENT DOCUMENTS

| | | | |
|---|---|---|---|
| 2004/0035897 | A1 | 2/2004 | Salentine et al. |
| 2004/0180631 | A1 | 9/2004 | Lim et al. |
| 2005/0011982 | A1 | 1/2005 | Salentine et al. |
| 2005/0255898 | A1 | 11/2005 | Huang |
| 2006/0054729 | A1 | 3/2006 | Salentine et al. |
| 2006/0287006 | A1 | 12/2006 | McIntyre et al. |
| 2007/0235492 | A1 | 10/2007 | Sirichai et al. |
| 2009/0008419 | A1 | 1/2009 | Tsang et al. |
| 2009/0084697 | A1 | 4/2009 | Gross |
| 2011/0009164 | A1 | 1/2011 | Amiri |

* cited by examiner 45
11
15
30
28
31
33
12
45
46
29
40
13
14

SELF-ALIGNING CATCH AND LATCH

TECHNICAL FIELD

This application relates generally to mechanical latches, and more particularly to an over-center latch and catch assembly.

BACKGROUND OF THE INVENTION

Tension latch mechanisms are commonly used to secure two or more components together in a closed configuration. Moreover, "over-center" tension latches are commonly used because a force applied to separate the two components tends to further secure the latch mechanism. One feature of conventional over-center latch mechanisms is that once the latch has rotated beyond a tipping-point of its arc, the latch "snaps" into a closed position, and the latch mechanism should not return to its open position unless a force is supplied to open the latch. Conventional latch mechanisms generally require two-handed operation and cannot be easily operated without visual inspection of the mechanism. Accordingly, conventional tension latch mechanisms are less suitable for applications where the user is engaged in certain activities, such as mountain biking, rock climbing, or hunting which require the user's uninterrupted attention and physical control. Additionally, conventional tension latch mechanisms generally require the user to properly align the mechanism in order for the tension latch mechanism to be properly secured in the closed position.

As such, there is a need for an over-center catch and latch assembly configured for one-handed operation, and configured for operation using tactile sensation alone. Additionally, there is a need for a over-center catch and latch assembly configured to correct minor misalignments between the catch and the latch. Moreover, there is a need for an over-center catch and latch assembly configured for quiet operation.

SUMMARY OF THE INVENTION

The present invention is directed to an assembly configured to secure two or more components together in a locked or closed configuration. According to an embodiment of the present invention, a latch and catch assembly is provided for releasably securing a container having a first portion and a second portion. In one embodiment, the catch and latch assembly includes a catch affixed to the first portion, the catch having a lip. In a further embodiment, the assembly includes a latch having an attachment portion and a pull-tab opposite the attachment portion, the attachment portion having a recess configured to receive the lip. In one embodiment, the recess formed in the latch is crescent-shaped. In a further embodiment, a step is formed between the attachment portion and the pull-tab. In another embodiment, the assembly includes a tensile member having two ends affixed to the second portion, the tensile member having a portion connected to the latch. In a more detailed embodiment, the tensile member is attached to the latch through an opening formed in the latch, and the latch is located generally at a midpoint along the length of the tensile member. In a further embodiment, the attachment portion of the latch has an edge about which the latch pivots against the lip while moving between a latched position and an unlatched position, and the tensile member is configured to apply a predetermined amount of force on the latch toward the catch as the latch pivots against the lip. In another embodiment, the latch is configured to assume a tipping position while moving between the latched position and the unlatched position. In another embodiment, the catch has a wider proximal portion which tapers to a narrower distal portion, such that the catch has a "V"-shaped planform. In another embodiment, a ridge is formed on a distal end of the pull-tab. In yet another embodiment, the pull-tab forms a reflex angle with the attachment portion of the latch.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

The present invention relates generally to mechanical latches, and more particularly to an over-center catch and latch assembly. In general, the over-center catch and latch assembly is provided to securely hold two components together in a closed or locked position, such as a lid hingedly connected to a carrying case. The over-center catch and latch assembly is self-aligning such that the assembly is configured to correct minor misalignments between the catch and the latch. Additionally, the latch assembly is configured for one-handed operation using tactile sensation alone. Moreover, the over-center catch and latch assembly is configured for quiet operation.

Figure 1A:
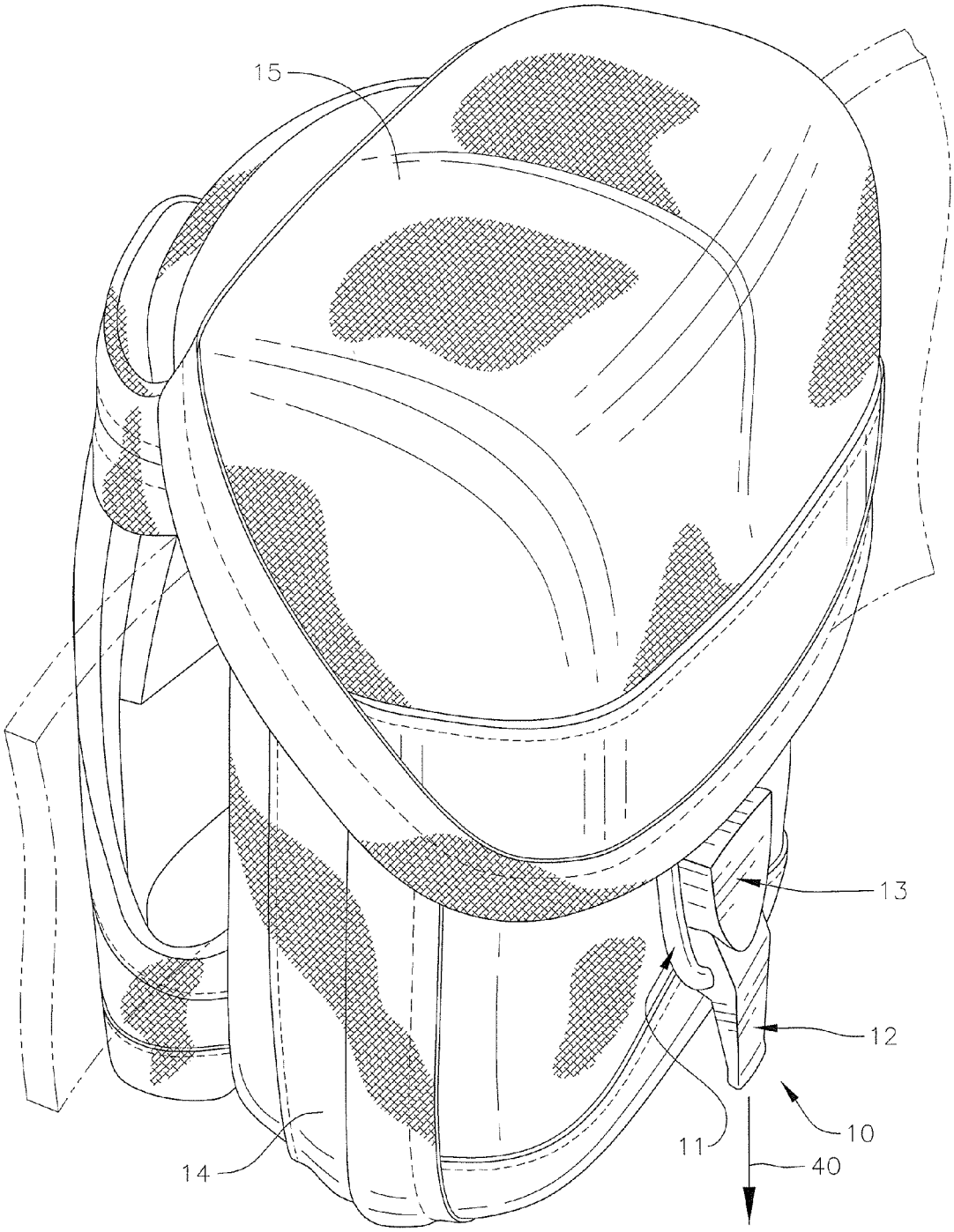
FIGS. 1A and 1B are a front perspective view of an embodiment of the over-center catch and latch assembly connected to a carrying case and a lid, showing the assembly in a closed position and an open position, respectively.
Figure 1B:
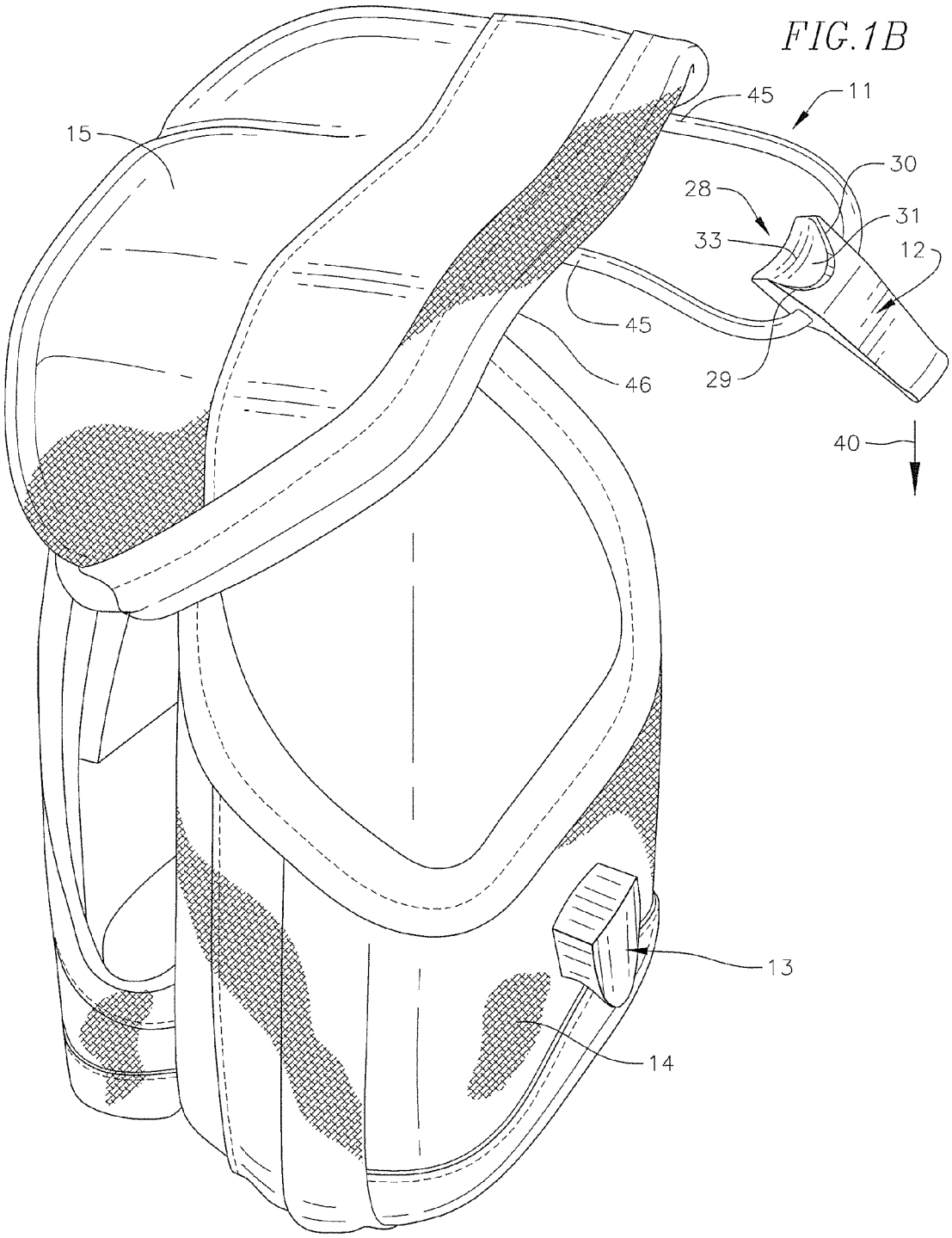

In an embodiment of the present invention shown in FIGS. 1A and 1B, an over-center catch and latch assembly 10 comprises a catch 13 and a tensile member 11 connected to a latch 12. In general, the catch 13 is attached to a first component and the tensile member 11 is attached to a second component. The latch 12 is configured to engage the catch 13 and thereby secure the two or more components in a closed configuration. The tensile member 11 is configured to supply a tensile force biasing the latch 12 to engage with the catch 13. In one embodiment, the catch 13 may be secured to a body of a carrying case 14 and the tensile member 11 may be attached to a lid 15 hingedly connected to the carrying case 14, such that the over-center catch and latch assembly 10 is configured to interlock the lid 15 to the carrying case 14 in a closed position, as shown in FIG. 1A. In one embodiment, the over-center catch and latch assembly 10 may be attached to a carrying case 14 which is mountable to the user's belt or strap by means of a clip or strap. Releasing the latch 12 from the catch 13 allows the user to lift and rotate the lid 15 back into the open position, as shown in FIG. 1B. In one embodiment, the tensile member 11 may be formed from any suitably elastic material, such as natural rubber or polychloroprene for example, in the form of a bungee cord. In an alternative embodiment, the tensile member 11 may be formed from a coil spring. A first and second end 45 of the tensile member 11 may be connected and fixed to the second component (e.g., a lid 15 hingedly connected a carrying case 14) by any suitable means, such as adhering, bonding, or fastening. Similarly, the catch 13 may be secured to the first component (e.g., a carrying case 14) by any suitable means, such as bonding, adhering, or fastening. In the illustrated embodiment, the ends 45 of the tensile member 11 are affixed to an outer edge 46 of the lid 15 and spaced apart from each other by a predetermined distance. In the illustrated embodiment, the distance between the ends 45 of the tensile member is greater than a width of the catch 13. As described in detail below, spacing the ends 45 of the tensile member 11 apart from each other advantageously tends to encourage and bias the latch 12 to self-align with the catch 13. In an alternate embodiment, the first end 45 of the tensile member 11 may be attached to a second component and the second end 45 of the tensile member 11 may be attached to a third component, such that the assembly 10 is configured to secure three components together in a closed configuration.

Figure 2A:
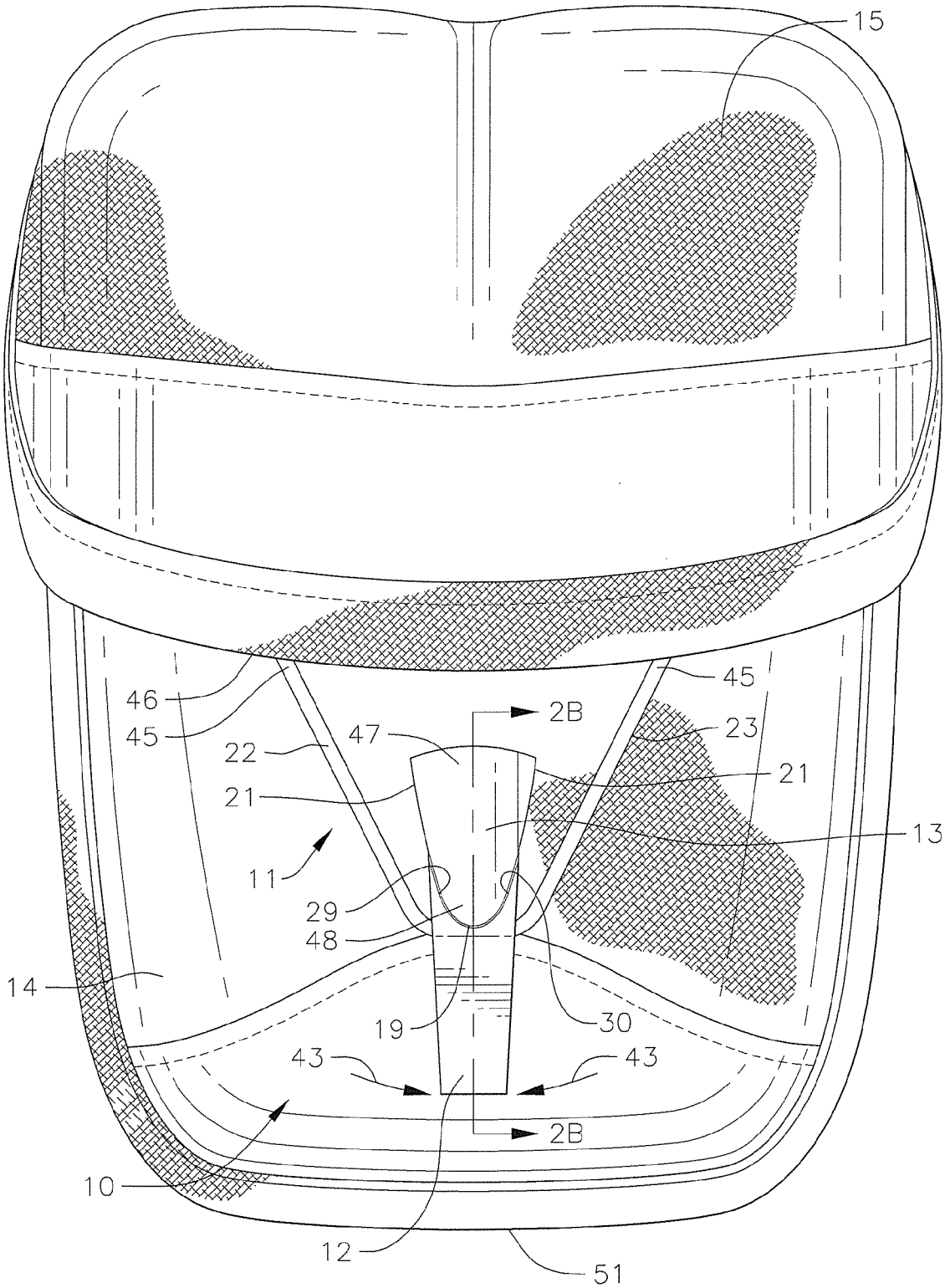
FIG. 2A is a front view of an embodiment of the over-center catch and latch assembly.
Figure 2B:
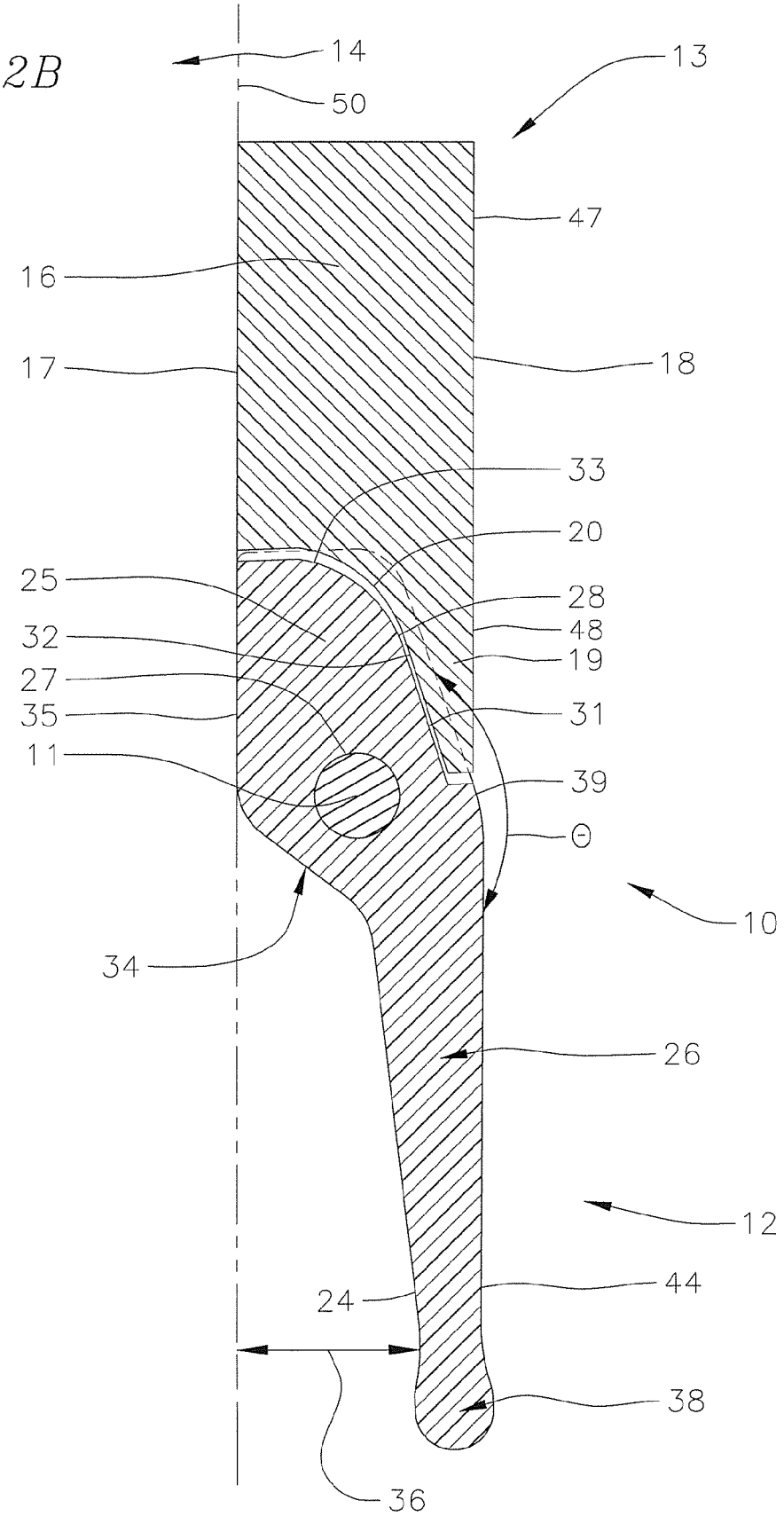
FIG. 2B is a cross-sectional view of the embodiment shown in FIG. 2A.

Referring now to FIGS. 2A and 2B, in the illustrated embodiment the catch 13 comprises a somewhat elongated body 16 having an inner surface 17 and an outer surface 18 that is raised and protrudes from an outer surface 50 of the carrying case 14. The outer surface 18 of the catch 13 has a wider proximal portion 47 adjacent to the edge 46 of the lid 15. The wider proximal portion 47 tapers to a narrower distal portion 48 distal to the edge 46 of the lid 15, such that the catch 13 has tapered edges 21 forming a "V"-shaped or triangular planform, as shown in FIG. 2A. The distal portion 48 of the catch 13 comprises a lip 19, with an undercut or notch 20 having a lesser thickness than that of the thicker proximal portion 47 of the catch 13. In one embodiment, the notch 20 formed under the lip 19 has a concave arcuate profile, as shown in FIG. 2B. The lip 19 and the notch 20 are configured to receive the latch 12 and thereby secure the over-center catch and latch assembly 10 in the closed position. As described in detail below, the lip 19 formed in the catch 13 is configured to overhang a portion of the latch 12 and thereby supply a force which resists the latch 12 from inadvertently disengaging the catch 13.

The catch 13 may be formed from any suitably strong and durable material, such as acetal plastic, thermoplastic polyurethane, aluminum alloy, or carbon fiber reinforced plastic. The catch 13 may be formed from any suitable process, such as liquid injection molding, milling, composite layering, or rapid prototyping using additive manufacturing.

With continued reference to FIGS. 2A and 2B, the latch 12 of the assembly 10 has an elongated body with a longitudinal axis defined by a proximal attachment portion 25 and a distal pull-tab portion 26 extending from the attachment portion 25. The attachment portion 25 of the latch 12 includes a transverse opening 27, such as a through hole extending generally perpendicularly to the longitudinal axis, configured to receive a mid-section of the tensile member 11. In one embodiment, the opening 27 in the latch 12 is curvilinear. In the disclosed embodiment, the opening 27 is located on a distal end of the attachment portion 25 such that the portion of the tensile member 11 attached to the latch 12 is generally distal to the lip 19 of the catch 13 when the assembly 10 is in the closed position. The mid-section of the tensile member 11 extends through the opening 27 in the attachment portion 25 of the latch 12 and may be fixedly attached to the latch 12 by any suitable means, such as adhering, bonding, fastening, or with an interference fit, in order to prevent the latch 12 from sliding along the length of the tensile member 11, which may make it difficult or cumbersome for the user to secure the latch 12 to the catch 13. With the latch 12 located at or near a midpoint along the length of the tensile member 11, a first segment 22 and a second segment 23 of the tensile member 11 have a substantially equal length, as shown in FIG. 2A. Fixing the latch 12 at or near the midpoint of the tensile member 11 ensures that the tension in the first segment 22 and the second segment 23 of the tensile member 11 are substantially equal when the over-center catch and latch assembly 10 is in the closed position (FIG. 2A). Otherwise, a difference in the tension between the two segments 22, 23 of the tensile member 11 may tend to cause the latch 12 to rotate (arrows 43) about the catch 13 in the direction of the greater tensile force and thereby disengage the catch 13.

Still referring to FIGS. 2A and 2B, in the illustrated embodiment the attachment portion 25 of the latch 12 includes a recess 28 (see also FIG. 1B) configured to fittingly engage the lip 19 formed on the narrower, thinner distal portion 48 of the catch 13. When the over-center catch and latch assembly 10 is in the closed position, the lip 19 formed on the catch 13 is nested in the recess 28 formed in the latch 12. In the disclosed embodiment, the recess 28 is formed in an outer surface 39 of the attachment portion 25 of the latch 12. Moreover, the recess 28 is oriented such that the widest portion of the recess 28 is located on a proximate end of the latch 12 and the narrowest portion of the recess 28 is located on a more distal portion of the latch 12 so that it substantially matches the shape of the lip 19. Best seen in FIG. 1B, the recess 28 is defined by two convergent walls 29, 30 and a base portion 31, where the recess 28 is substantially crescent-shaped. The two convergent walls 29, 30 extend outwardly from the base 31 to form the recess 28.

When the catch and latch assembly 10 is in the closed position, the tapered edges 21 of the lip 19 rest substantially flush against the two convergent walls 29, 30 of the recess 28 and an inner surface 32 of the notch 20 rests substantially flush on the base portion 31 of the recess 28. In the disclosed embodiment, the depth of the recess 28 in the latch 12 is substantially equal to the thickness of the lip 19 formed on the catch 13 so that the outer surface 18 of the catch 13 is substantially flush with an outer surface of the latch 12 (best seen in FIG. 2B). In an alternative embodiment, the depth of the recess 28 formed in the latch 12 may be substantially greater or lesser than the thickness of the lip 19 formed on the catch 13. Additionally, although a specific shape of the recess 28 is described, it will be appreciated that the recess 28 may have other shapes that are consistent with the scope and spirit of the invention, provided the recess can receive the notch 20 for releasably locking the latch 12 to the catch 13. In an alternate embodiment, the attachment portion 25 of the latch 12 may include a slot (not shown) configured to receive the lip 19 formed on the catch 13.

In the embodiment illustrated in FIG. 2B, a proximal end of the attachment portion 25 of the latch 12 has a curved profile 33 (see also FIG. 1B) configured to abut the notch 20 formed in the catch 13 when the catch and latch assembly 10 is in the closed position. That is, the proximal end of the attachment portion 25 has a convex profile 33 configured to rest substantially flush against the concave notch 20 formed in the distal end of the catch 13.

With reference now to FIG. 2A, the tapered convex shape of the lip 19 formed on the distal portion 48 of the catch 13 and the matching (e.g., tapered concave) recess 28 formed in the latch 12 are configured to self-align the latch 12 with the catch 13. That is, the tapered convex shape of the lip 19 formed on the catch 13 and the matching concave shape of the recess 28 formed in the latch 12 are configured to correct minor misalignments between the catch 13 and the latch 12. The tapered configuration of the lip 19 formed in the catch 13 and the recess 28 formed in the latch 12 tend to encourage and bias a misaligned latch 12 to rotate (arrows 43) about the catch 13 and into the properly aligned position. Additionally, when the latch 12 is misaligned with the catch 13, the two segments 22, 23 of the tensile member 11 provide different tensile forces, and this tensile difference also tends to cause the latch 12 to rotate (arrows 43) into the properly aligned position (i.e., the latch 12 tends to rotate (arrows 43) in the direction of the greater tensile force). Specifically, if a user slightly misaligns the latch 12 with the catch 13, the differential force supplied by the two segments 22, 23 of the tensile member 11 tends to cause the latch 12 to rotate (arrows 43) about the catch 13 such that the lip 19 formed in the distal portion of the catch 13 slides along the convergent walls 29, 30 of the recess 28 until the tapered edges 21 of the lip 19 are properly aligned (i.e., flush) with the two convergent walls 29, 30 of the recess 28 and the latch 12 lies generally along a longitudinal axis of the assembly 10.

In the disclosed embodiment of FIG. 2B, the attachment portion 25 of the latch 12 is thicker than the pull-tab portion 26 of the latch 12. Additionally, in the disclosed embodiment the latch 12 includes a step 34 between the thicker attachment portion 25 and the relatively thinner pull-tab portion 26 of the latch 12. By occupying all or nearly all of the space between the lip 19 and the component (e.g., carrying case 14) to which the catch 13 is attached, the thicker attachment portion 25 ensures that the latch 12 is snug against the catch 13 when the assembly is in the closed position. The thicker attachment portion 25 is also configured to compensate for the reduction in thickness due to the recess 28 formed in the attachment portion 25 of the latch 12.

In the disclosed embodiment an inner surface 35 of the attachment portion 25 of the latch 12 is configured to rest flush against the outer surface 50 of the component (e.g., a carrying case 14) to which the catch 13 is secured. In contrast, the pull-tab portion 26 of the latch 12 is configured to be spaced apart from the component to which the catch 13 is secured, thereby forming a gap 36 between an inner surface 24 of the pull-tab portion 26 and the outer surface 50 of the component. The gap 36 between the pull-tab portion 26 and the component is configured to enable the user to easily and conveniently grasp the pull-tab 26 when the assembly 10 is in the closed configuration (FIG. 1A). In an alternate embodiment, the pull-tab portion 26 of the latch 12 could extend below a lower portion 51 (FIGS. 2A and 3) of the component to which the catch 13 is connected in order to enable the user to easily and conveniently grasp the pull-tab 26 of the latch 12 when the assembly 10 is in the closed position (e.g., the pull-tab portion 26 of the latch 12 could be significantly elongated so the pull-tab 26 extends over the lower portion 51 of the carrying case 14, and/or the catch 13 could be located nearer the lower portion 51 of the carrying case 14 so that the pull-tab portion 26 of the latch 12 extends over the lower portion 51 of the carrying case 14).

Figure 4:
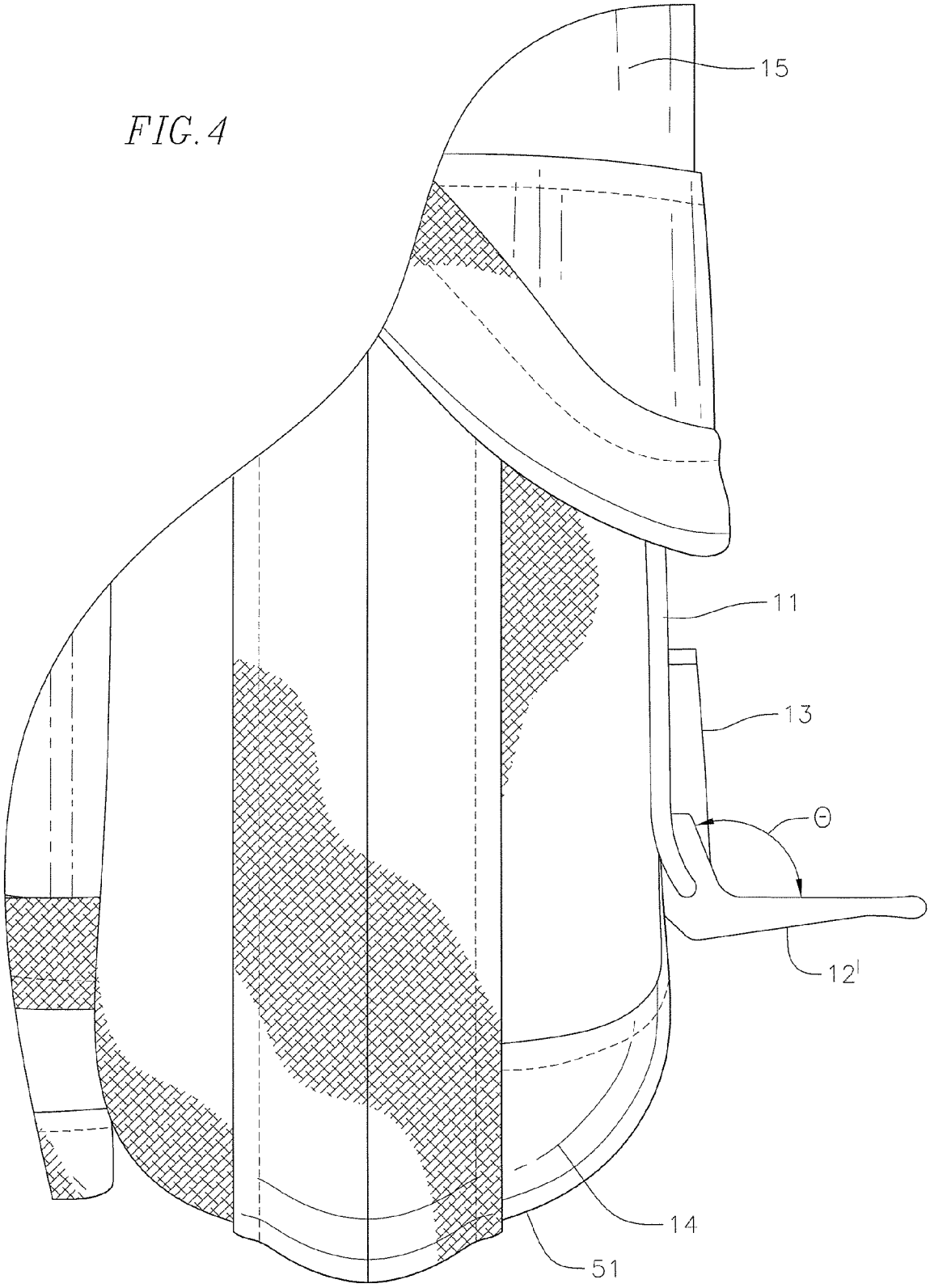
FIG. 4 is a side view of an embodiment of the over-center catch and latch assembly.

With continued reference to FIG. 2B, in one embodiment a reflex angle θ is formed between the attachment portion 25 and the pull-tab portion 26 of the latch 12. The reflex angle θ may be greater than about 180°, preferably between about 190° and 225°, and more preferably about 200°. In the disclosed embodiment, the reflex angle θ formed between the outer surface 39 of the attachment portion 25 and an outer surface 44 of the pull-tab portion 26 of the latch 12 is about 200° such that the pull-tab portion 26 of the latch 12 is substantially parallel with the outer surface 18 of the catch 13. The reflex angle θ enables the recess 28 formed in the latch 12 to mate with the lip 19 and the arcuate notch 20 formed in the catch 13 while allowing the pull-tab portion 26 of the latch 12 to be substantially parallel to the component (e.g., a carrying case 14) which advantageously minimizes, or at least reduces, the overall profile thickness of the assembly 10. A narrow profile advantageously reduces the risk that a foreign object will snag on the pull tab 26 and thereby disengage the latch 12 from the catch 13. Additionally, it will be appreciated that although the attachment portion 25 and the pull-tab portion 26 of the latch 12 have been described as forming a reflex angle θ, the pull-tab portion 26 could alternatively form any suitable angle with the attachment portion 25 of the latch 12. For instance, in the embodiment illustrated in FIG. 4, the pull-tab portion 26 of the latch 12' may an angle θ (e.g., ranging between about 80° and 110°) with the attachment portion 25 of the latch 12' such that the pull-tab portion 26 extends perpendicularly away from the component (e.g., a carrying case 14) to which the catch 13 is connected when the assembly 10 is in the closed position. In one embodiment, having the pull-tab portion 26 of the latch 12' extend perpendicularly away from the carrying case 14 enables the user to easily locate the pull-tab 26 through tactile sensation alone.

As described above, the latch 12 includes a relatively thin and elongated pull-tab portion 26 which extends away from the catch 13 when the assembly 10 is in the closed position. The pull-tab 26 is configured to permit the user to easily grasp the latch 12 with one hand and thereby move the over-center catch and latch assembly 10 between the open position (FIG. 1B) and the closed position (FIG. 1A). In one embodiment, a distal end of the pull-tab 26 includes an enlarged portion 38. In the embodiment illustrated in FIG. 2B, the enlarged portion 38 is formed as a ridge to prevent the user's grasp from inadvertently slipping off the distal end of the pull-tab 26 when the user is moving the assembly 10 between the open position and the closed position. In an alternate embodiment, the distal end of the pull-tab 26 may include a return flange configured to prevent the user's grasp from inadvertently slipping off the lower end of the pull-tab 26. The pull-tab 26 may also include other friction-inducing surface features, such as a knurled surface, etching, striations, or a coating.

In the illustrated embodiment of FIGS. 2A and 2B, the profile thickness of the pull-tab 26 tapers from the thickest portion near the attachment portion 25 to the thinnest portion near the distal end of the pull-tab 26. The tapered thickness of the pull-tab 26 is configured to enable the user to determine through tactile sensation the distal end of the pull-tab 26. For instance, the user may slide his/her fingers along the pull-tab 26 and thereby determine the distal end of the pull-tab 26 by sensing the direction in which the thickness of the pull-tab 26 tapers. Similarly, in the illustrated embodiment, the planform of the pull-tab 26 tapers from the widest portion near the attachment portion 25 to the narrowest portion near the distal end of the pull-tab 26. Accordingly, the tapered width and tapered thickness of the pull-tab 26 advantageously permit the user to determine through tactile sensation the distal end of the latch 12 and thereby the direction in which to pull the pull-tab 26 in order to secure and release the latch 12 from the catch 13 (e.g., in the illustrated embodiment, the direction of the force required to open and close the assembly 10 corresponds to the direction in which the width and thickness of the pull-tab 26 taper). The latch 12 may be formed from any suitably strong and durable material, such as acetal plastic, thermoplastic polyurethane, aluminum alloy, or carbon fiber reinforced plastic. The latch 12 may be formed from any suitable process, such as liquid injection molding, milling, composite layering, or rapid prototyping using additive manufacturing. In one embodiment, the materials of the latch 12 and catch 13 are selected to minimize the noise generated by opening and closing the over-center catch and latch assembly 10.

In use, the user secures together two or more components in a locked or closed configuration using the catch and latch assembly 10. In the illustrated embodiment, the catch and latch assembly 10 is configured to secure a lid 15 hingedly connected to a carrying case 14, wherein the tensile member 11 is connected to the lid 15 at its two ends 34 and the catch 13 is connected to the carrying case 14. The user first rotates the lid 15 to change between the open position (FIG. 1B) into the closed position (FIG. 1A). The user may rotate the lid 15 into the closed position by pulling (arrow 40) the latch 12 toward the catch 13. When the latch 12 is at or near the catch 13, the user pulls distally (arrow 40) on the pull-tab portion 26 of the latch 12 thereby causing the tensile 11 member to elongate. The user then continues to pull distally on the latch 12 until the latch 12 extends below the lip 19 of the catch 13.

Figure 3:
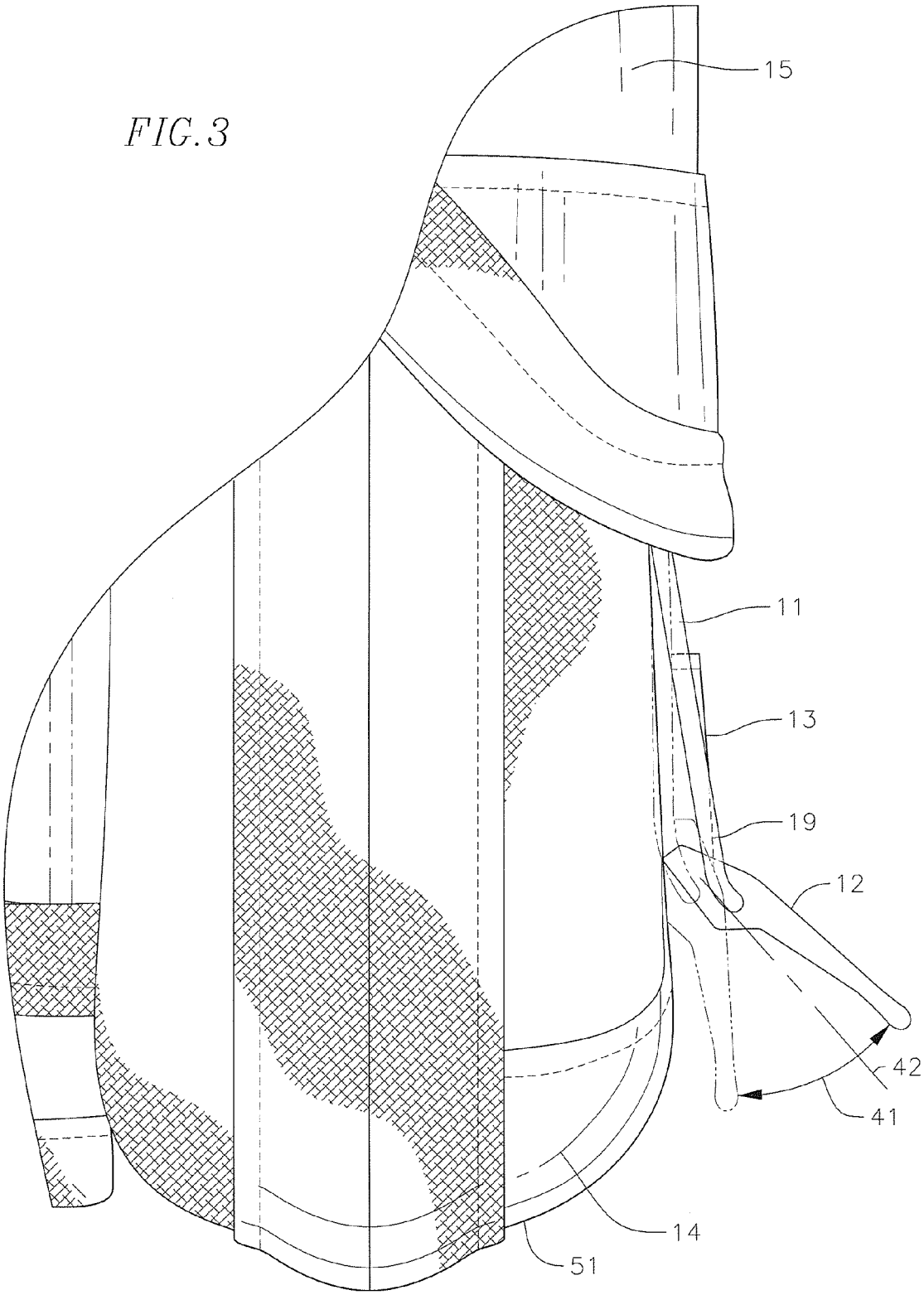
FIG. 3 is side view of an embodiment of the over-center catch and latch assembly, showing the over-center feature of the latch.

The user then causes the latch 12 to rotate through an arc (arrow 41) (e.g., ranging between 45° and 90°) around the lip 19 of the catch 13, as shown in FIG. 3. Said another way, the latch 12 is configured to engage the catch 13 by pivoting (arrow 41) through an arc from an open position (shown in solid lines in FIG. 3) to a closed position (shown in phantom lines in FIG. 3). As the latch 12 pivots around the lip 19, the tensile member 11 further elongates. Once the latch 12 has rotated (arrow 41) beyond a tipping-point 42 of its arc, the latch 12 should not return to its open position unless a force is supplied to open the latch 12. Moreover, once the latch 12 has rotated (arrow 41) beyond the tipping-point 42, the latch 12 "snaps" into the closed position (shown in phantom lines in FIG. 3). The tipping-point 42 of the arc is a function of the position of the opening 27 through which the tensile member 11 is attached to the latch 12. In general, the more distal the opening 27 is formed in the latch 12, the smaller the tipping-point 42 of the arc (i.e., the more distal the tensile member 11 is connected to the latch 12, the farther the user must rotate the latch 12 along its arc until the latch 12 snaps into the closed position). The over-center latch design is advantageous, for instance, because a force applied to open the lid 15 increases the tensile force in the tensile member 11 which further secures the latch 12 to the catch 13.

The user then releases the latch 12 and the tensile force supplied by the elongated tensile member 11 then causes the tensile member 11 to contract around the catch 13 (i.e., the restorative force supplied by the elastically deformed tensile member 11 causes the tensile member 11 to contract around the catch 13 when the user releases the pull-tab 26 of the latch 12). Alternatively, the user may release the latch 12 after it has pivoted (arrow 41) past the tipping-point 42 of its arc rather than releasing the latch 12 after it has pivoted (arrow 41) through its entire arc. In the closed position, the lip 19 nests in the recess 28 formed in the latch 12 and the curved profile 33 of the latch 12 abuts the arcuate notch 20 of the catch 13, as shown in FIG. 2B.

To open the over-center catch and latch assembly 10, the user performs the aforementioned steps in reverse. Specifically, to release the latch 12 from the catch 13, a sufficient force must be supplied to elongate the tensile member 11 such that the latch 12 passes over and around the lip 19 formed in the narrower lower end of the catch 13. In this regard, when the over-center latch and catch 10 is in the closed configuration, the tensile member 11 is in a "potential energy well" because sufficient energy must be supplied to the tensile member 11 to extend the tensile member 11 around the lip 19 and thereby return the assembly 10 to its open configuration (FIG. 1A) and the tensile member 11 to its state of lowest potential energy.

With continued reference to FIGS. 2A and 2B, the asymmetry of the catch 13 between the wider, thicker proximal portion 47 and the narrower, thinner distal portion 48 advantageously permits the user to determine the orientation of the catch 13 through tactile sensation alone (i.e., the V-shaped planform of the catch 13 permits the user to determine the orientation of the catch 13 without visual inspection of the assembly 10). Accordingly, the V-shaped planform of the catch 13 permits the user to adjust the catch and latch assembly 10 between the open position (FIG. 1B) and the closed position (FIG. 1A) without looking at the assembly 10. Said another way, the tapered configuration of the catch 13 enables the user to determine through tactile sensation alone the distal portion 48 of the catch 13, which thereby enables the user to open and close the over-center catch and latch assembly 10 without looking at the assembly 10 because the distal portion 48 of the catch 13 includes the lip 19 which engages the latch 12 in the closed position. Operating the latch and catch assembly 10 through tactile sensation alone is advantageous, for instance, when visual inspection might be dangerous because the user is engaged in an activity that requires the full attention of the user, such as mountain biking, rock climbing, or hunting. Additionally, the tapered shape of the catch 13 advantageously enables the user to locate the lip 19 formed on the catch 13 irrespective of the orientation of the latch and catch assembly 10 relative to the user's body. For example, in one embodiment, the latch and catch assembly 10 may be attached to a carrying case 14 having a hinged lid portion 15, wherein the carrying case 14 is mountable to the user's belt or strap in either a vertical or horizontal configuration. An example of a carrying case 14 mountable to a user's belt in either a vertical or horizontal configuration is shown and described in U.S. patent application Ser. No. 13/340,505, which is hereby incorporated by reference in its entirety. In this disclosed embodiment, the tapered shape of the catch 13 enables the user to locate the lip 19 formed on the catch 13 through tactile sensation alone when the carrying case 14 is in mounted in either the horizontal or vertical configuration, or any configuration therebetween. Although the catch 13 has been described with reference to a V-shaped configuration, the catch 13 may alternatively be formed from a different shape, such as an ovaloid or a trapezoidal protrusion, where there is asymmetry between the proximal and distal portions 48, 47 of the catch 13, respectively, without departing from the spirit and scope of the present invention.

In accordance with a feature of the present invention, the user can "toggle" the latch 12 from its tipping point 42 to either a latched or unlatched position. This feature further facilitates the user to operate the assembly solely through tactile sensation. Moreover, tension applied by the tensile member 11 on the latch 12 toward the catch 13 and the corresponding shapes of the lip 19 and the recess 28 render the assembly 10 self-aligning along the longitudinal axis of the assembly 10 in the closed position.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "distal, "proximal" and similar terms have been used herein to describe a spatial relationship of one element to another, it is understood that these terms are intended to encompass different orientations of the various elements and components of the device in addition to the orientation depicted in the figures. For instance, although the preceding description referred to a lid portion connected to a carrying case, the carrying case may alternatively be attached to bottom portion. Moreover, the figures contained in this application are not necessarily drawn to scale.

What is claimed is:

1. A latch and catch assembly for releasably securing together a first component and a second component of a container, comprising:

a catch affixed to the first component, the catch having a lip;

a latch having an attachment portion and a pull-tab opposite the attachment portion, the attachment portion having a recess configured to receive the lip, the recess tapering between a wider end distal to the pull-tab and a narrower end proximal to the pull-tab; and a tensile member having two ends affixed to the second component, the tensile member having a portion connected to the latch, wherein the latch is configured to pivot against the lip to move between a latched position and an unlatched position, wherein the tensile member is configured to apply a force on the latch toward the catch when the latch is in the latched position, wherein the lip is received in the recess when the latch is in the latched position, and wherein the tensile member extends around the catch when the latch is in the latched position.

2. The assembly of claim 1, wherein the latch is configured to assume a tipping position while moving between the latched position and the unlatched position.

3. The assembly of claim 1, wherein the portion of the tensile member connected to the latch is a mid-portion of the tensile member.

4. The assembly of claim 1, wherein the portion of the tensile member extends through the attachment portion of the latch.

5. The assembly of claim 1, wherein the catch has a wider proximal portion which tapers to a narrower distal portion.

6. The assembly of claim 1, wherein the latch comprises thermoplastic polyurethane.

7. The assembly of claim 1, wherein the catch comprises thermoplastic polyurethane.

8. The assembly of claim 1, wherein the latch is located generally at a midpoint along the length of the tensile member.

9. The assembly of claim 1, further comprising an opening formed in the latch, wherein the tensile member extends through the opening in the latch.

10. The assembly of claim 9, wherein the opening formed in the latch is distal to the lip when the latch is in the latched position.

11. The assembly of claim 1, wherein the recess formed in the latch is crescent-shaped.

12. The assembly of claim 1, wherein the attachment portion of the latch comprises a first thickness and the pull-tab formed on the latch comprises a second thickness, the first thickness being greater than the second thickness such that a step is formed between the attachment portion and the pull tab.

13. The assembly of claim 1, wherein an outer surface of the pull-tab forms a reflex angle with an outer surface of the attachment portion of the latch.

14. The assembly of claim 1, further comprising a ridge formed on a distal end of the pull tab.

15. The assembly of claim 1, wherein the lip on the catch has a tapered convex shape and the recess in the latch has a tapered concave shape, and wherein the engagement between the lip and the recess is configured to bias the latch into proper alignment with the catch.

16. A latch and catch assembly for releasably securing together a first component and a second component of a container, comprising:

a catch affixed to the first component, the catch having a lip;

a latch having an attachment portion and a pull-tab opposite the attachment portion, the attachment portion having a recess configured to receive the lip, the recess tapering between a wider end distal to the pull-tab and a narrower end proximal to the pull-tab; and a tensile member having two ends affixed to the second component, the tensile member having a portion connected to the latch, wherein the latch is configured to move between an unlatched position and a latched position, wherein the tensile member is configured to apply a force on the latch toward the catch when the latch is in the latched position, wherein the lip is received in the recess when the latch is in the latched position, and wherein the catch is disposed between the latch and the two ends of the tensile member when the latch is in the latched position.

17. The latch and catch assembly of claim 16, wherein the two ends of the tensile member are spaced apart by a distance greater than a width of the catch.

* * * * *